United States Patent [19]

Boyer

[11] Patent Number: 4,864,748

[45] Date of Patent: Sep. 12, 1989

[54] MATERIALS TRANSPORT AND DISTRIBUTION APPARATUS

[75] Inventor: Mark L. Boyer, Houston, Tex.

[73] Assignee: Boyer, Inc., Houston, Tex.

[21] Appl. No.: 149,700

[22] Filed: Jan. 29, 1988

[51] Int. Cl.[4] ..... E02F 5/22

[52] U.S. Cl. ..... 37/142.5; 37/117.5; 414/526

[58] Field of Search ..... 37/142.5, 81, 117.5, 37/DIG. 3; 241/260.1; 414/351, 353, 392, 394, 488, 489, 491, 526, 724

[56] References Cited

U.S. PATENT DOCUMENTS

| | | | |
|---|---|---|---|
| 2,755,092 | 7/1956 | Donahoe | 275/1 |
| 2,815,195 | 12/1957 | Bolt | 37/117.5 |
| 2,857,691 | 10/1958 | Curran | 37/144 |
| 2,932,101 | 4/1960 | Ludowici | 37/117.5 |
| 3,065,556 | 11/1962 | Kampert | 37/117.5 |
| 3,503,450 | 3/1970 | Day | 37/142.5 |
| 3,596,384 | 8/1971 | Neujahr | 37/142.5 |
| 3,934,363 | 1/1976 | McMurray | 37/142.5 |
| 4,055,255 | 10/1977 | Vasquez | 214/2 |
| 4,084,853 | 4/1978 | Keenan | 414/526 |
| 4,283,867 | 8/1981 | Brown | 37/142.5 |
| 4,301,910 | 11/1981 | Price | 198/304 |
| 4,438,885 | 3/1984 | Martin | 241/260.1 |
| 4,583,905 | 4/1986 | Scherr | 414/526 |
| 4,664,791 | 4/1987 | McClain | 209/420 |
| 4,669,945 | 6/1987 | Pollard et al. | 414/526 |

FOREIGN PATENT DOCUMENTS

| | | | |
|---|---|---|---|
| 2470200 | 6/1981 | France | 414/526 |
| 617541 | 7/1978 | U.S.S.R. | 37/81 |
| 688561 | 9/1979 | U.S.S.R. . | |

OTHER PUBLICATIONS

Caterpillar Brochure IT-28 (2-85) AEHQ4521 "Integrated Tool Carrier".

*Primary Examiner*—Eugene H. Eickholt
*Attorney, Agent, or Firm*—Vaden, Eickenroht, Thompson & Boulware

[57] ABSTRACT

A bucket with an auger rotatably mounted in the bottom for use with a construction vehicle for materials transport and distribution such as fill material for an excavation project. The bucket is fitted on one side with a dispensing pipe through which the auger extends so that the fill material moves from the bucket through the dispensing pipe by action of the auger. The fill material is delivered in a uniform manner through the dispensing pipe.

9 Claims, 3 Drawing Sheets

MATERIALS TRANSPORT AND DISTRIBUTION APPARATUS

BACKGROUND AND SUMMARY OF THE INVENTION

Filling and excavation projects often require the transport of fill material to the site. In addition, a prescribed fill material of sand, stabilized sand, gravel and the like is often required by local authorities for service line trench backfilling. This requires that the backfilling operation include the transportation of material to the fill site, labor and equipment to spread the fill material.

The fill material is often required to be a certain uniform depth around the service line. Certain materials are expensive and an uneven fill using more material than necessary will be costly. Also, the labor to spread the fill material can be costly.

The present invention is an apparatus that can be readily attachable to a construction vehicle, such as a tool carrier, and transports and delivers, in a uniform manner, fill material at the site. The apparatus is a specially designed bucket mounted to the front of a construction vehicle.

The bucket can be sized to fit the purpose typically from ½ to 2 yard bucket size used with most utility tool carriers to a 15 yard size or larger. The bucket has an auger placed lengthwise towards the bottom which is rotatably mounted. The size of the auger depends on the bucket size and materials to be handled. The auger is actuated to rotate by a motor at the operator's direction.

The auger extends through an opening on one side of the bucket and is surrounded by a dispensing pipe which pipe has a closure on the terminal end. Near the end of the dispensing pipe is a chute which communicates to the end of the auger inside the dispensing pipe.

In operation, the bucket is loaded and transports material to a trench or an excavation site to be filled. The vehicle operator aligns the bucket with the dispensing pipe and the chute opening extending over the excavation area.

The operator actuates the auger which causes the fill material to travel along with the rotation of the blades from inside the bucket through the dispensing pipe and out the chute. In filling a trench the vehicle can travel along side and dispense the fill material in a uniform manner. This operation not only reduces cycle time for unloading and spreading material, but also reduces waste of special fill materials which must be laid in a prescribed depth around a service line or otherwise.

The auger section and dispensing pipe can be detachable from the side of the bucket by a threaded connection or other convenient method of attachment. The bucket and detached pipe can be more easily transported to other job sites.

DESCRIPTION OF THE PREFERRED EMBODIMENT

Figure 1:
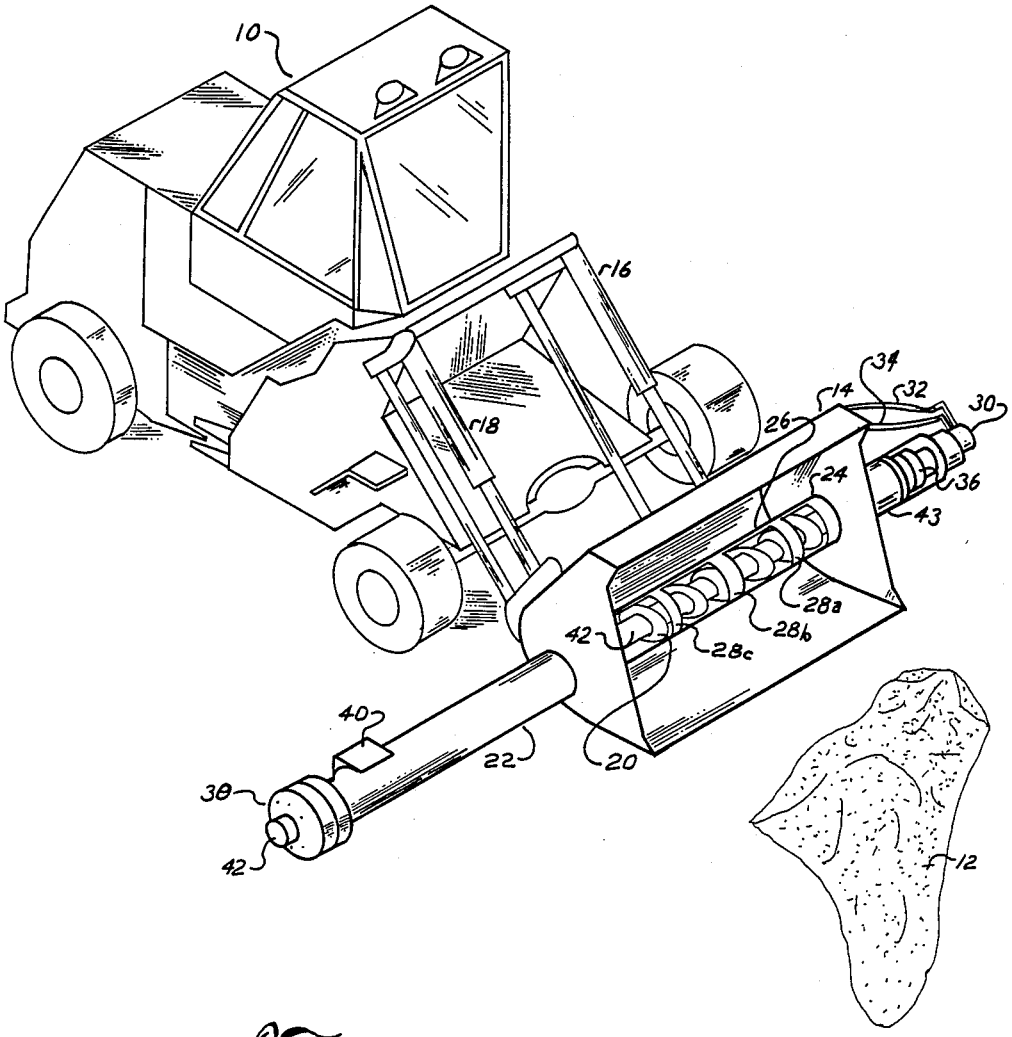
FIG. 1 is a perspective view to the side front of the apparatus attached to a vehicle beginning the process of scooping up material.

The materials transport and distribution apparatus is shown in FIG. 1 mounted to a construction vehicle 10 such as a front end loader or tool carrier. The vehicle is shown approaching a load of material 12 such as trench filler sand, gravel or other loose material that needs to be transported and distributed at the work site. Bucket 14 is mounted at its rear to the front of the vehicle 10 in a conventional coupling or other convenient manner so that the vehicle's handling arms 16 and 18 connected to the rear of the bucket 14 can lift and rotate bucket 14.

The bucket 14 and mounting (not shown) can be designed to fit existing equipment. The apparatus can be sized depending on the load site and materials to be used at the job site. The apparatus can be designed to be used with any type of vehicle which can carry the bucket as herein described.

An auger 20 has an auger shaft 42 and helical blade or flighting 48 mounted on the shaft 42. Auger 20 is rotatably mounted in the bottom of the bucket 14. The auger 20 can be sized for the type of material to be used. Dispensing pipe 22 extends from the side of bucket 14 and communicates through an opening to the inside of bucket 14. Auger 20 extends through the opening in the bucket and through the dispensing pipe 22. Auger shaft 42 is rotatably mounted in closure 38 at the terminal end of dispensing pipe 22. The auger shaft 42 can be supported at either end on bearings inside closure 38 and inside extension 43 so that the shaft freely rotates. Any other free rotation mechanism for the auger shaft can be used.

The auger 20 is held in the bottom of bucket 14 by auger retainer 24 which is mounted lengthwise in the bottom of bucket 14. The auger retainer 24 as shown in FIG. 1 includes a length of retainer pipe 26 sized to received auger 20. The retainer pipe 26 in the preferred embodiment is an extension inside the bucket 14 of dispensing pipe 22. Retainer pipe 26 has an opening lengthwise which exposed the auger to the contents of bucket 14. Retainer piper 26 has auger retainer straps 28a, 28b, and 28c spaced crosswise along the length of the opening of auger retainer pipe 26 and are attached to the auger retainer pipe 26 and span the opening thereof. The auger retainer straps 28a, 28b and 28c form cage-like straps to keep the auger 20 within auger retainer 24 in case there is a failure of the auger mountings or the intrusion of large objects for any reason which might bend or dismount the auger shaft 42. The auger retainer 24 is sized so that the auger 20 can rotate freely inside of the retainer pipe 26, and similarly the dispensing pipe 22 is sized to allow rotation within of the auger 20.

The auger shaft 42 is attached to any suitable drive mechanism to rotate the auger 20. In FIG. 1 a hydraulic motor 30 is indicated with hydraulic fluid lines 32 and 34 associated with the operation of the apparatus. A coupling 36 is generally indicated in FIG. 1. The hydraulic motor can be situated recessed in the bucket for a more streamlined design. A chain coupling or other type of device can be used with the motor to co-act with auger shaft 42 to provide a connection between the power source and the auger. When the auger shaft 42 is rotated during a dispensing operation the auger flighting 48 rotates so that the material travels along the path of the flighting from inside the bucket 14, through the dispensing pipe 22.

As shown in FIG. 1, auger shaft 42 is rotatably mounted in an extension 43 of retainer pipe 26. Extension 43 is part of retainer pipe 26 which extends outside of bucket 14 adjacent to the hydraulic motor 30 and coupling 36. In an alternative embodiment the motor and coupling could be recessed in the bucket without extension 43.

Dispensing pipe 22 has chute 40 which extends from pipe 22 just before the closure 38 and communicates with the inside of pipe 22 where the auger 20 extends. In FIG. 1 the apparatus is shown attached to the front of a vehicle approaching a load of material 12 for pick-up. In the embodiment shown the opening of chute 40 is parallel to the ground in the loading position of FIG. 1.

Figure 2:
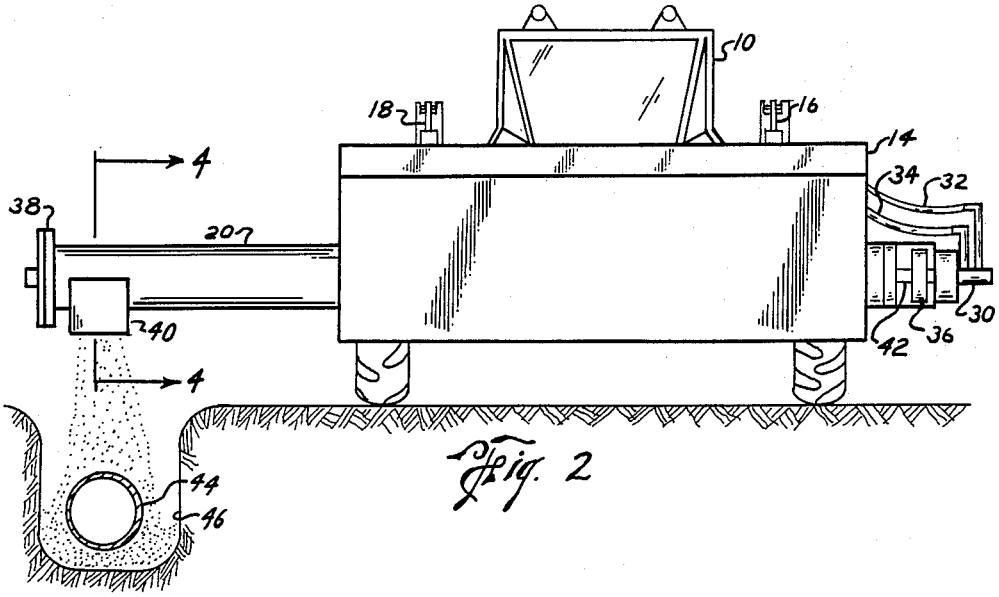
FIG. 2 is a front view of the apparatus attached to a vehicle with a section into a trench showing a filling process.

In FIG. 2, the apparatus is shown from the front is dispensing position. The service line 44 to be laid with proper fill is shown in trench 46. The bucket 14 has been loaded with fill material and rotated by handling arms 16 and 18 to hold the bucket 14 in an upright position. The dispensing pipe 22 has been rotated so that the opening of chute 40 is pointed down into trench 46. The auger shaft 42 has been actuated by motor 30 to rotate and the fill material is carried by the auger flighting 48 through the dispensing pipe 22 to chute 40 and falls into trench 46. FIG. 2 shows the material falling from the opening chute 40 into trench 46 around service line 44.

Figure 4:
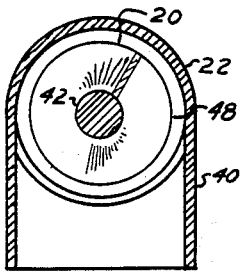
FIG. 4 is a cross-section of the chute section lines 4—4 shown on FIG. 2.
Figure 7:
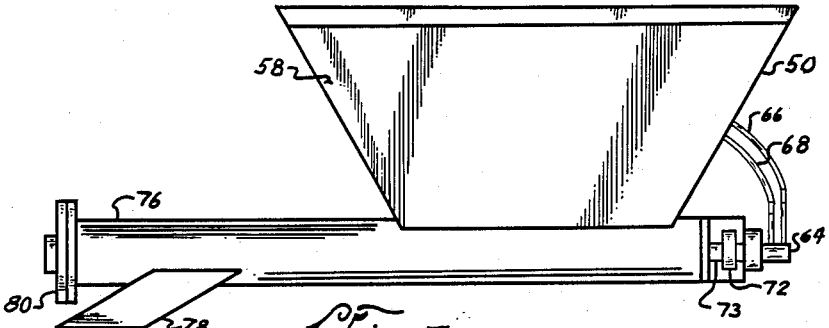
FIG. 7 is a front view of the alternative embodiment.
Figure 8:
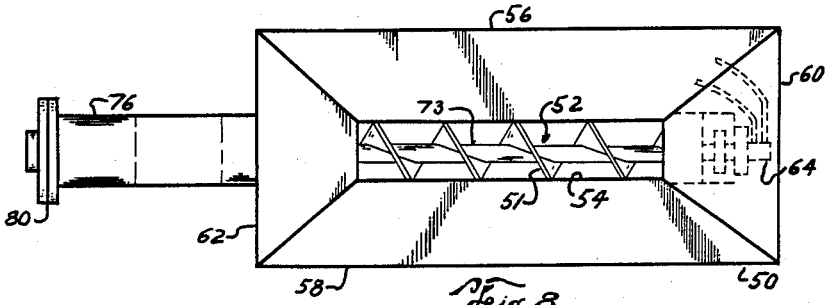
FIG. 8 is a top view of the alternative embodiment.
Figure 6:
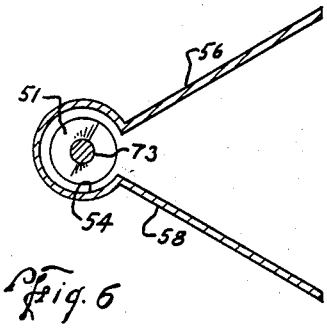
FIG. 6 is a cross-section of the alternative embodiment taken at the section lines 6—6 on FIG. 5.
Figure 5:
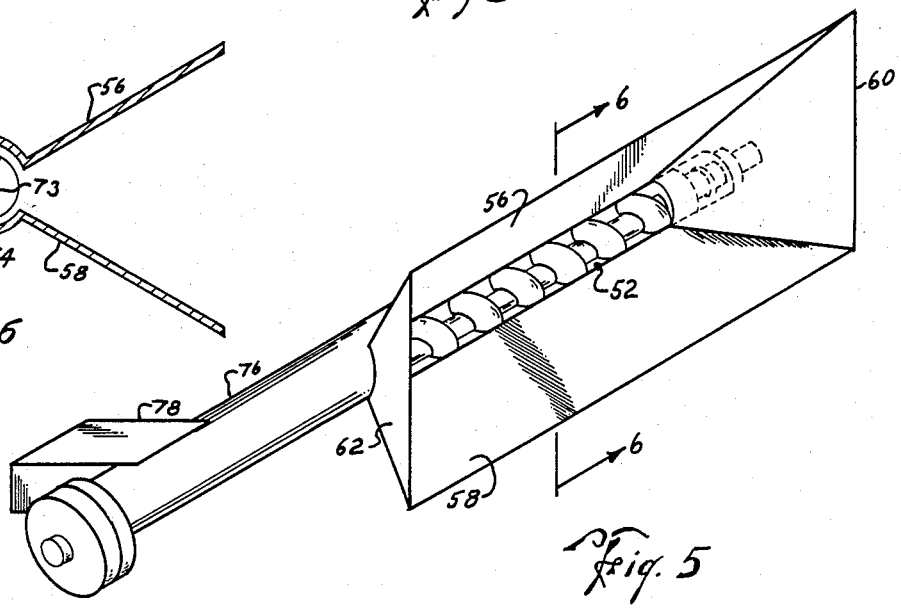
FIG. 5 is a perspective view of the front of an alternative embodiment of the apparatus.

FIG. 4 is a cross-section taken at 4—4 of FIG. 2 of the dispensing pipe 22, chute 40 and auger 20. Auger flighting 48 is shown a helix fixed around shaft 42. A length of flexible hose (not shown) can be attached to surround firmly the opening of chute 40. The hose attachment is used to further direct the flow of fill material and prevent blowing of material during windy conditions.

Figure 3:
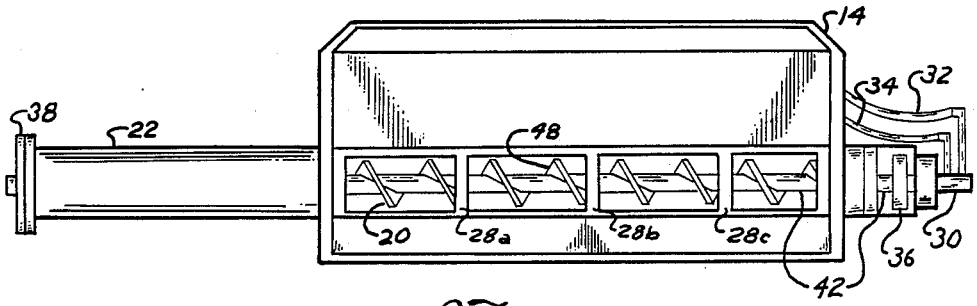
FIG. 3 is a view into the top of the apparatus.

FIG. 3 is a view of the bucket 14 looking inside. The auger 20 is shown in auger retainer 24. Retainer straps **28*a*, 28*b* and 28*c* are shown across the opening in retainer pipe 26. The dispensing pipe 22 extending from bucket 14 is shown as well as the motor 30 and coupling 36**.

An alternative embodiment for the bucket design and auger retainer are shown in FIGS. 5, 6, 7 and 8. The bucket 50 has auger 52 mounted in a generally cylindrical recess 54 extending lengthwise from the back of the bottom of bucket 50. The auger 52 has auger shaft 73 to which a helical blade auger flighting is mounted. The shape of bucket 50 is hopper-like with side walls 56 and 58 and end walls 60 and 62 which incline toward the auger recess 54. The recess 54 is sized so that auger 52 can freely rotate within. Recess 54 has an opening lengthwise of the bottom of bucket 50 which allows the auger 52 to communicate with the contents of bucket 50.

The alternative embodiment is shown with correlative parts to the embodiment described above. A hydraulic motor 64 is actuated with fluid pumped through lines 66 and 68. The motor 64 actuates auger 52 through coupling 72 which is disposed between motor 64 and auger shaft 73 which extends outside the bucket 50. On the other end of bucket 50 extends a dispensing pipe 76 which is a cylindrical pipe extension of recess 54.

Auger 52 extends through dispensing pipe 76 to the end where chute 78 dispenses the contents of the dispensing pipe 76 travelling along the auger flighting 51. Closure 80 caps the end of dispensing pipe 76 and has bearings mounting the auger shaft 73. The alternative embodiment operates in the same manner described below for the first embodiment. The alternative embodiment has a hopper bucket which aids in directing material to the center of the bucket and the auger. Also the auger 52 is protected in recess 54.

In operation the materials transport and distributor apparatus performs as follows. As shown in FIG. 1 the bucket 14 is rotated by the action of the operator of vehicle 10 moving the handling arms 16 and 18. The vehicle is driven by the operator to approach a load of material 12 with the bucket opening parallel to and close to the surface. The bucket 14 scoops up a load of material. The operator then rotates bucket 14 so the mouth is in a relatively upward position and the vehicle can travel to the fill site without spilling the material.

The vehicle 10 travels to the trench or other fill or distribution area for the material. As shown in FIG. 2, the vehicle is aligned parallel to the trench 46 and the opening of chute 40 is aligned over the trench 46. When the bucket 14 is in the upright position the opening of chute 40 is in a downward direction. The dispensing pipe 22 extends sideways from the bucket 14 so that the vehicle 10 can travel alongside the excavation without getting too close to operate.

When the operator has the chute 40 properly aligned, the motor 30 is actuated to rotate the auger shaft 42. The rotation of the auger 20 causes the material to travel along the path of the auger 48 from the inside of the bucket 14, through the dispensing pipe 22 and out chute 40 as shown in FIG. 2. The auger extends from the length of the bucket 14 to the chute area.

As the auger 20 is rotated, the vehicle 10 travels at the desired rate of speed parallel to the trench. The fill materials is delivered at the rate needed for the project. A uniform fill can be achieved with the apparatus of this invention. Once the load of material is delivered to process is repeated.

While the preferred embodiment and alternative embodiment of the invention has been described, it will be understood that various modifications of the invention can be made without departing from the principles of the invention.

What is claimed is:

1. A materials transport and distribution apparatus for use with a construction vehicle, comprising:

a bucket with a mounting for a vehicle such that said bucket may be selectively lifted and rotated;

a dispensing pipe extending from one side of the bucket which communicates with the inside of the bucket;

an auger in the bottom of the bucket extending through said dispensing pipe and said auger rotatably mounted to transfer material from the bucket through said dispensing pipe;

means to secure said auger in the bottom of said bucket; and means to selectively rotate said auger to transfer materials through said dispensing pipe.

2. A materials transport and distribution apparatus for use with a construction vehicle as set forth in claim 1, wherein:

said means to selectively rotate said auger is a hydraulic means.

3. A materials transport and distribution apparatus for use with a construction vehicle as set forth in claim 1, wherein:

said dispensing pipe is detachable from the side of the bucket.

4. A materials transport and distribution apparatus for use with a construction vehicle as set forth in claim 1, wherein:

the dispensing pipe and section of auger therein are removable from the side of the bucket.

5. A materials transport and distribution apparatus for use with a construction vehicle as set forth in claim 1, wherein:

said bucket has a generally cylindrical recess in the bottom of the bucket sized to receive said auger; and means associated with said recess to retain said auger within said recess.

6. A materials transport and distribution apparatus for use with a construction vehicle;

a bucket with a mounting for a vehicle; a dispensing pipe extending from one side of the bucket which communicates with the inside of the bucket;

an auger in the bottom of the bucket extending through said dispensing pipe;

means to secure said auger in the bottom of said bucket;

said bucket having end walls and side walls inclined toward the bottom of the bucket; hydraulic means to selectively rotate said auger;

said dispensing pipe and section of auger therein removable from the side of said bucket;

said bucket having a generally cylindrical recess in the bottom of the bucket sized to receive said auger; and means associated with said recess to retain said auger within said recess.

7. A materials transport and distribution apparatus for use with a construction vehicle, comprising:

a bucket;

a mounting on said bucket for attachment to a vehicle;

a dispensing pipe extending from one side of the bucket which communicates with the inside of the bucket;

a closure on the terminal end of the dispensing pipe;

a chute on the end of said dispensing pipe on the end opposite the attachment to the bucket;

an auger in the bottom of said bucket extending through said dispensing pipe;

an auger retainer mounted inside said bucket consisting of a portion of cylindrical retainer pipe extending lengthwise from side to side in the bottom of the bucket with an opening extending the substantial length of the retainer pipe, said retainer pipe sized to receive the auger;

a sufficient number of retainer straps extending across the opening to surround the auger in the auger retainer; and hydraulic means to selectively rotate said auger within said bucket and said pipe.

8. A materials transport and distribution apparatus for use with a construction vehicle as set forth in claim 7, including:

a flexible hose attaching to the opening of said chute on said dispensing pipe.

9. A materials transport and distribution apparatus for use with a construction vehicle as set forth in claim 7, wherein:

said bucket has end walls and side walls inclined toward the bottom of the bucket.

* * * * *